US005967826A

United States Patent [19]

Letailleur

[11] Patent Number: 5,967,826

[45] Date of Patent: Oct. 19, 1999

[54] TERMINAL BLOCK WITH BEVELED EDGE FOR REDUCED CROSSTALK AND METHOD

[75] Inventor: Jean-Pierre Letailleur, Cluses, France

[73] Assignee: Pouyet S.A., France

[21] Appl. No.: 08/975,102

[22] Filed: Nov. 20, 1997

[30] Foreign Application Priority Data

Dec. 20, 1996 [FR] France ..... 96 16076

[51] Int. Cl.[6] ..... H01R 4/24

[52] U.S. Cl. ..... 439/402; 439/709

[58] Field of Search ..... 439/395–404, 439/676, 709, 941, 745

[56] References Cited

U.S. PATENT DOCUMENTS

| | | | |
|---|---|---|---|
| 4,060,302 | 11/1977 | Saligny . | |
| 5,344,336 | 9/1994 | Sampson | 439/399 |
| 5,494,461 | 2/1996 | Bippus et al. | 439/709 |
| 5,556,296 | 9/1996 | Dussausse et al. | 439/404 |
| 5,762,516 | 6/1998 | Itoga et al. | 439/404 |
| 5,820,404 | 10/1998 | Chishima et al. | 439/404 |

FOREIGN PATENT DOCUMENTS

| | | | |
|---|---|---|---|
| 0370380 | 5/1990 | European Pat. Off. | 439/404 |
| 0 637 097 A1 | 2/1995 | European Pat. Off. . | |
| 0 654 851 A1 | 5/1995 | European Pat. Off. . | |
| 2 330 159 | 5/1977 | France . | |

*Primary Examiner*—Khiem Nguyen
*Attorney, Agent, or Firm*—Parkhurst & Wendel, L.L.P.

[57] ABSTRACT

This invention relates to a terminal block for interconnection of telephone or computer-related lines having a rate of rejection of near-end crosstalk complying with very strict standards. The extended portion of each insulation-displacing contact has a bevel on an edge which is next to the adjacent pair increasing the distance therebetween and reducing the crosstalk.

5 Claims, 3 Drawing Sheets

FIG. 1
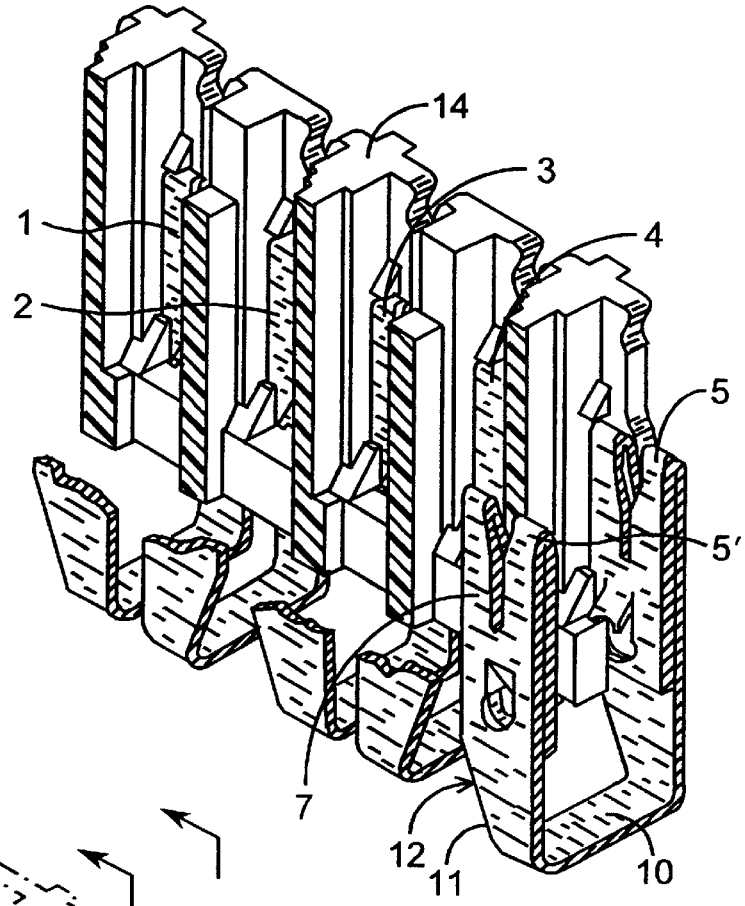
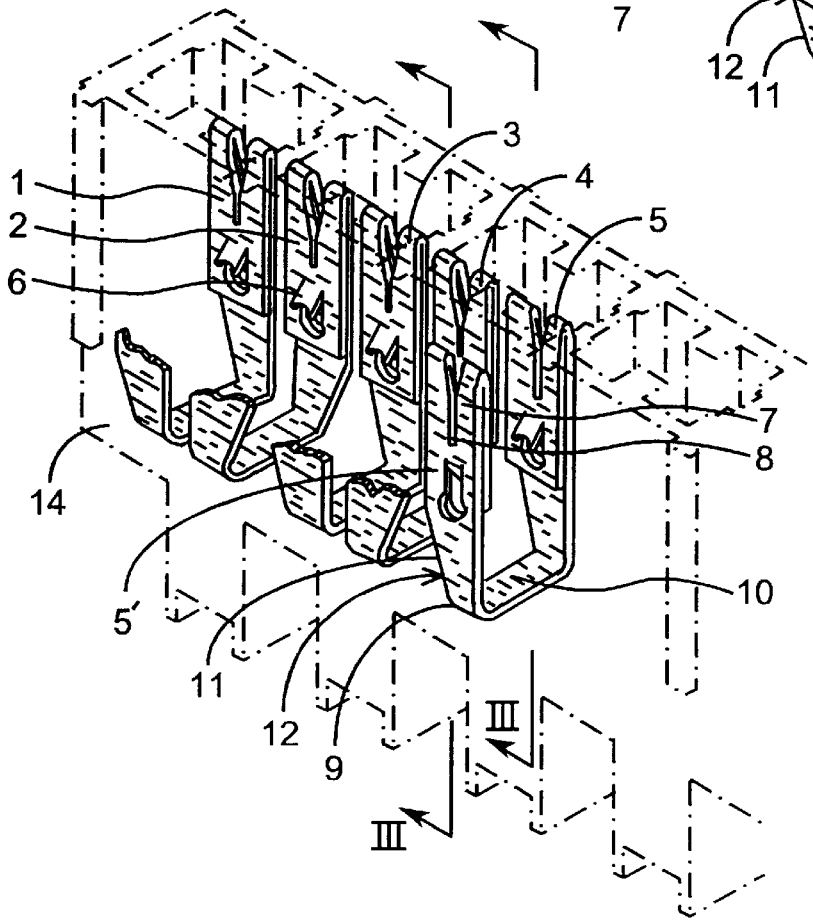
FIG. 2

TERMINAL BLOCK WITH BEVELED EDGE FOR REDUCED CROSSTALK AND METHOD

FIELD OF THE INVENTION

The present invention relates to a process for producing a terminal block for interconnection of telephone or computer-related lines. It also relates to a terminal block obtained by this process.

BACKGROUND OF THE INVENTION

Such terminal blocks currently equip telephone distribution frames in which they serve to connect, on request, the different monopair lines of the Telephone Distribution Company to the different corresponding lines of subscribers. There are several hundreds, and even several thousands of them.

These prior art terminal blocks all comprise at least two parallel rows of substantially flat metal contacts, placed opposite from one row to the other, these metal contacts each being provided with an axial slot for insulation-displacing connection of the wires to be connected. A contact of this type is for example described in document FR-A-2 330 159.

The contacts of the same row are coplanar. The contacts of the two parallel rows mentioned above are identical.

Each contact of one of these two conjugate rows is connected, to ensure continuity of the two lines, to the contact conjugate with respect to (i.e. opposite) the other row by a metal link which is either a link presenting a possibility of cut, in which case it is question of conjugate contacts "with cut", or a direct link without possibility of cut, in which case it is question of conjugate contacts in "U" form.

One of these two conjugate contacts is called "input contact", as it receives one of the two wires of the incoming line (coming from the Telephone Distribution Company), while the other contact is called "output contact", as it receives the corresponding wire of the two-wire outgoing line (i.e. the subscriber's line).

On each row among these two opposite rows, there is found a determined number of pairs of adjacent contacts, this number of pairs depending on the width of the terminal block.

Each pair of contacts is used for receiving the two wires of a telephone line, i.e. of the incoming line for the row containing the above-mentioned input contacts, and of the outgoing line for the row containing the said output contacts.

The substantially flat contacts which equip the terminal blocks presently marketed by Applicants are fairly similar to the one forming the subject matter of document FR-A-2 330 159 and in particular to the one shown in FIG. 1 of that document. Of course, such a contact comprises the principal part which is flat and of generally fixed width, which contains the insulation-displacing slot, and this principal part extends by a part of substantially the same width, which will be referred to as "extension" and which serves here to connect this contact to the conjugate contact mentioned above, i.e. to the contact which lies opposite on the other row.

When it is question of a link with cut, this extension is elastic and it comprises, at its free end, a stud for contact with the identical elastic conjugate extension of the conjugate contact opposite it. When it is question of a link in U form, this extension is common to that of this conjugate contact, with which it therefore constitutes a linking bridge made in one piece.

With the present increase in the operational frequencies of telephone and computer-related installations, a problem is raised, for these terminal blocks, of the rate of near end crosstalk between two adjacent pairs, the current terminal blocks of the prior art no longer complying with the standards of rejection of near end crosstalk which are now in force and which are much more strict than the standards which are applied to the terminal blocks of the prior art mentioned above.

To give an idea, for frequencies which may go up to 100 Megahertz, a rate of rejection of near end crosstalk between adjacent pairs which is greater than 40 dB is now required, whereas a rate of rejection of near end crosstalk merely greater than 20 dB was accepted in the past.

Manufacturers must in that case:

- either increase the distance between two adjacent pairs on the same row of contacts, which has for a drawback either of increasing the dimensions of the terminal block for the same number of pairs, or of reducing the number of pairs if the same dimensions are conserved for this terminal block,
- or, as for example described in document EP-A-0 637 097 and EP-A-0 654 851, to reduce the dimensions of each contact in width to a maximum, this having for a drawback to render the latter more fragile than desired in order to obtain good reliability.

It is an object of the present invention to overcome these drawbacks.

SUMMARY OF THE INVENTION

To that end it relates to a process for producing a terminal block for interconnection of telephone or computer-related lines, this terminal block comprising at least two parallel rows of conjugate, metal insulation-displacing contacts, each of these insulation-displacing contacts having a principal part which comprises the insulation-displacing slot for connection, this principal part continuing in an extension which serves to connect this metal contact to its conjugate metal contact (i.e. the one placed opposite on the other row), the contacts of the same row being grouped in pairs of adjacent contacts, each pair receiving the two wires of the same two-wire line (telephone or computer-related), this process being characterized in that it consists, in order to obtain a rate of rejection of near-end crosstalk between two adjacent pairs which is greater than that of a known standard prior art terminal block without having to increase the distance between two adjacent pairs of contacts of the same row, in mounting in this standard terminal block, which therefore presents an insufficient rate of rejection of near-end crosstalk between adjacent pairs, metal contacts whose principal part is unchanged in width but whose extension is bevelled on the edge which is adjacent the immediately neighbouring contact of the adjacent pair on the same row.

The invention also relates to a terminal block for interconnection of telephone or computer-related lines, this terminal block being made in accordance with the process mentioned above and being characterized in that said extended portion, thus bevelled, of each insulation-displacing contact is an elastic extended portion which comprises a stud for contact at its free end, with the result that these two conjugate elastic extended portion thus constitute a link with cut which is bevelled on only one of its two edges, the one which is next to the mirror link and immediately adjacent the two adjacent conjugate pairs.

The invention also relates to a terminal block for interconnection of telephone or computer-related lines, this terminal block being produced in accordance with the process mentioned above and being characterized in that said extension, thus bevelled on one edge only, of each insulation-displacing contact is an extension which is common to that of the corresponding conjugate contact, with the result that these two conjugate extensions thus constitute a linking bridge produced in one piece and bevelled on only one of its two edges, the one which is next to the mirror bridge and immediately adjacent the two adjacent conjugate pairs.

BRIEF DESCRIPTION OF THE DRAWINGS

The invention will be more readily understood on reading the following description with reference to the accompanying drawings, in which:

FIG. 1 is a partial view in perspective, with parts torn away, of a terminal block with U links according to the invention.

FIG. 2 shows the terminal block of FIG. 1, with only the insulation-displacing contacts drawn in solid lines.

DESCRIPTION OF PREFERRED EMBODIMENT

Figure 3:
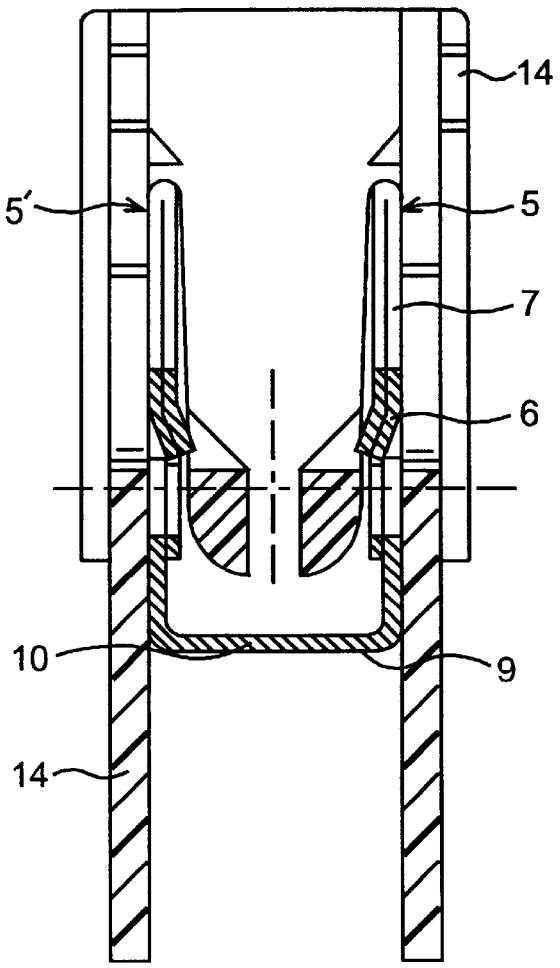
FIG. 3 is a transverse section of this same terminal block, made in the plane of the insulation-displacing slots of two U-link contacts, and more precisely along III—III of FIG. 2.

Referring now to the drawings, and firstly to FIGS. 1 to 4, the first embodiment relates to a terminal block with "U" links.

This terminal block comprises a body 14 made of plastics material which holds the two parallel rows R1 and R2 of insulation-displacing metal contacts firmly in position.

Only the first five contacts 1, 2, 3, 4, 5 of the first row R1 and the fifth contact 5' of the second row R2 have been shown in FIGS. 1 and 2.

Contact 5' is the conjugate contact of contact 5, i.e. it is the contact which, on the other row, is placed opposite this contact 5. The same applies to contacts 1', 2', 2' and 4' (FIG. 4) of row R2 which are respectively the conjugate contacts of contacts 1, 2, 3 and 4 of the other row R1.

Contacts 1 and 2 are intended to receive the two wires of the same two-wire line, for example of a first incoming line, and it is said that they constitute a "pair" of contacts forming part of the first row R1.

Similarly, contacts 3 and 4 are intended to receive the two wires of a second incoming line, and constitute a second pair of contacts of row R1, etc.

Contacts 1' and 2' of row R2, respectively conjugated with contacts 1 and 2, are intended to receive the two wires of a two-wire line, for example of a first outgoing line, which the terminal block has for its role to interconnect to the first incoming line on the conjugate contacts 1 and 2 of the other row R1. These contacts 1' and 2' form the first "pair" of contacts of row R2. As can be seen, two contacts therefore form a "pair" when they receive the two wires of the same monopair telephone or computer-related line.

Each contact comprises a principal portion 7 which receives the axial insulation-displacing slot 8 and which continues downwardly in an extension 9 which has for its role to connect the contact electrically to its conjugate contact.

The principal portion 7 of the contacts which are shown in FIGS. 1 to 3 is made, in accordance with Applicants' technology, with a strip folded and fitted with a "chink" 6 for alignment, but this particular embodiment is in no way compulsory for implementing the invention.

The terminal block according to FIGS. 1 to 4 being a terminal block with "U" links, each extended portion 9 of a contact is joined in one piece with the corresponding extension of the conjugate contact, in order finally to form a "U" linking bridge 10 between these two conjugate contacts (cf. for example conjugate contacts 5 and 5', the only ones shown completely in FIGS. 1 to 3 ).

For the terminal blocks marketed up to the present time by Applicants, the extension 9 of each contact has virtually the same width as the principal part 7 of this contact. These terminal blocks present a rate of rejection of near-end crosstalk, between adjacent pairs of the same row, which is of the order of 22 to 25 dB, which does not correspond to the present "category 5" standards which require a rate of rejection of near-end crosstalk greater than 40 dB.

In order to comply with these new "category 5" standards, the invention consists, in order to provide the terminal block with the same number of pairs as these standard terminal blocks of the prior art without increasing the distance between two adjacent pairs of the same row (for example between pairs 1, 2 and 3, 4 ) or reducing the width of the principal part of the contacts in order not to render them fragile, in mounting in this standard terminal block 14 metal contacts 1, 2, 3, 4, 5, . . . , 1', 2', 3', 4', 5', . . . , of which the principal part 7 therefore remains unchanged in width but of which the extension 9 is bevelled (12) on the edge 11 which is next to the immediately adjacent contact (4' for contact 5') of the pair of adjacent contacts 3', 4' on the same row R2.

In fact, in the terminal block according to FIGS. 1 to 4, the bridge 10 is therefore bevelled on one of its edges, i.e. the edge 11 which is next to the immediately adjacent "mirror"-bridge 10' (FIG. 4) of the two conjugate pairs of adjacent contacts 3, 4 and 3', 4'.

Figure 4:
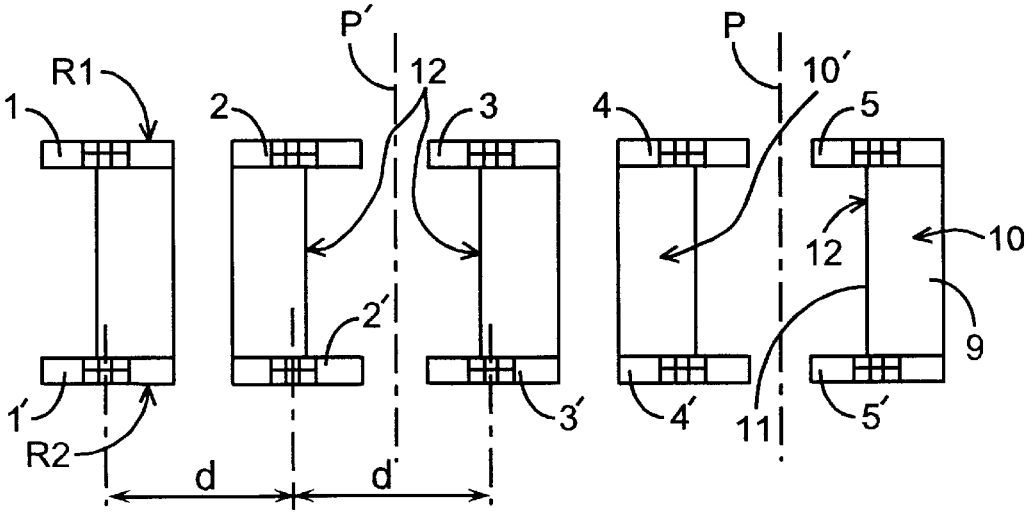
FIG. 4 is a very rudimentary plan view of this same terminal block, showing the "mirror" distribution of the contacts of this terminal block.

As shown in FIG. 4, the adjacent bridge 10' is symmetrical to this bridge 10 with respect to a plane P orthogonal to the plane of the terminal block and separating the conjugate contacts 4, 4' from the conjugate contacts 5, 5'. The bridge 10' is therefore the image of bridge 10 with respect to this plane P, hence the name of "mirror" bridge given here to bridge 10' with respect to bridge 10.

The same Applies to the conjugate contacts 2, 2' of which the bevel 12 is the "mirror" image the corresponding bevel 12 of the pair of conjugate contacts 3, 3' immediately adjacent the two conjugate pairs of contacts 3, 4 and 3', 4' adjacent to these two conjugate pairs of contacts 1, 2 and 1', 2', etc.

Figure 5:
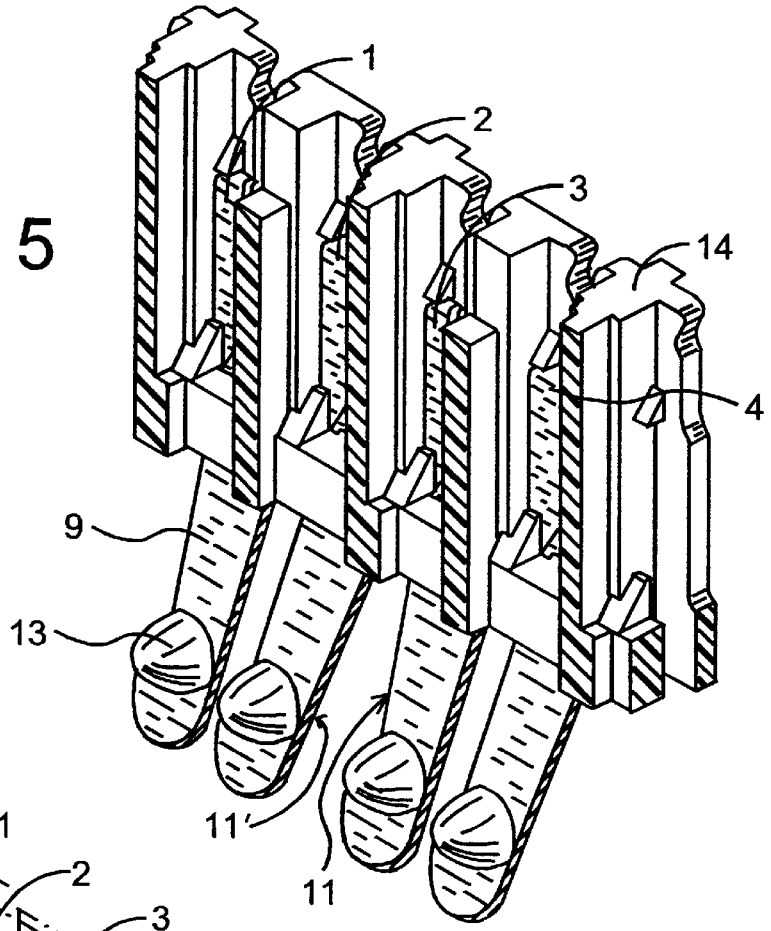
FIG. 5 is a view similar to FIG. 1, but showing the application of the invention to a terminal block incorporating links with cut.
Figure 6:
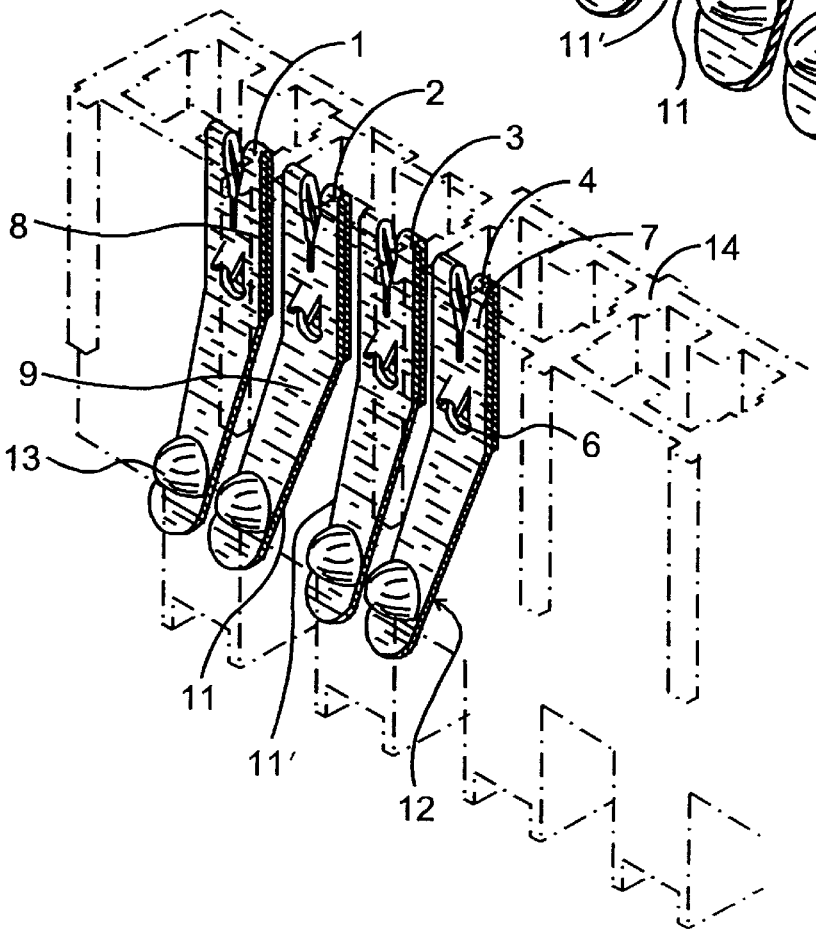
FIG. 6 is a view similar to FIG. 2, but relative to the terminal block of FIG. 5.

FIGS. 5 and 6 schematically show another embodiment which differs from that of FIGS. 1 to 4 in that the terminal block in question is a terminal block incorporating links with "cut" and no longer a terminal block with "U" links.

Each contact 1, 2, 3, 4, . . . is thus provided with an elastic extended portion 9 which comprises, at its free end, a stud 13 intended to establish electrical contact with the corresponding stud of the conjugate contact (not shown).

According to the invention, these extended portions 9 each comprise a bevel 12 similar to that which corresponds to the embodiment illustrated in FIGS. 1 to 4.

The two conjugate elastic extended portions 9 of two conjugate contacts thus constitute a link with cut which, as previously, is bevelled on only one of its two edges: edge 11 which is next to the mirror link and immediately adjacent the two adjacent conjugate pairs (cf. for example edges 11 and 11' in FIG. 6, symmetrical to one another with respect to a "mirror" plane corresponding to the plane P' indicated in preceding FIG. 4).

In order to give an idea by non-limiting numerical examples, the width of the principal part 7 of the contacts according to FIGS. 1 to 6 being conventionally 3.5 millimetres, the bevel 12 in the "U" embodiment of FIGS. 1 to 4 progressively reduces this width to 1.5 millimetres, while this bevel 12 in the embodiment with "cut" of FIGS. 5 and 6 reduces it to about 1 mm.

The distance between the axial slots of two adjacent contacts of the same row remaining, like for the standard terminal blocks presently marketed by Applicants, 5 millimetres (which corresponds to a pitch of 10 mm for the terminal block), the following was able to be measured:

on a "U" terminal block according to FIGS. 1 to 4, a rate of rejection of near-end crosstalk between two adjacent pairs of the order of 43 to 44 dB, and on a terminal block with "cut" according to FIGS. 5 and 6, a rate of rejection of near-end crosstalk between two adjacent pairs of the order of 41 to 42 dB.

It goes without saying that the invention is not limited to the two embodiments which have just been described. It is, of course, applicable to other types of terminal blocks, for example to the various terminal blocks described in document FR-A- 2 495 847 mentioned above. Although the contacts shown in the examples which have been described are substantially flat contacts, the invention is also applicable to terminal blocks equipped with insulation-displacing contacts which are not really flat, or even not flat at all.

What is claimed is:

1. In a terminal block for interconnection of telephone or computer-related lines, the terminal block comprising at least two parallel rows of opposing metal insulation-displacing contacts, each contact in a first row forming a conjugate pair with a contact in a parallel second row, each contact being capable of receiving one wire of a two-wire line, each of the insulation-displacing contacts comprising a vertically oriented principal portion having an insulation-displacing connection slot, and an extended portion connected to a lower end of the principal portion, wherein the improvement comprises:

the extended portion of each contact is beveled along an edge so that its width tapers in a direction away from the principal portion, and the beveled edge of the extended portion is adjacent to a beveled edge of an extended portion of an immediately neighboring contact in the same row.

2. A terminal block according to claim 1, wherein:

each extended portion of each contact is shaped so that a distal end thereof connects with a distal end of an extended portion of another contact located in the parallel row opposite said each contact, said two opposite contacts comprising a conjugate pair of contacts, thereby forming a linking bridge between the contacts of that pair, with another conjugate pair of contacts being immediately adjacent the aforesaid pair, and shaped in a mirror image of the aforesaid pair with the beveled edges of the adjacent pairs facing each other.

3. A terminal block according to claim 1, wherein:

said extended portion of each contact comprises an elastically displaceable portion having a contact stud at a free end thereof for connection with a contact stud on the elastically extendable portion of an opposing contact located in the parallel row opposite said each contact, said two opposite contacts comprising a conjugate pair of contacts, thereby forming a linking bridge between the contact studs of that pair, with another conjugate pair of contacts being immediately adjacent the aforesaid pair, and shaped in a mirror image of the aforesaid pair with the beveled edges of the adjacent pairs facing each other.

4. A method of building a terminal block with reduced crosstalk for terminal blocks having at least two parallel rows of opposing metal insulation-displacing contacts, the contacts opposite each other in the two parallel rows forming conjugate pairs, each contact being capable of receiving one wire of a two-wire line, and each insulation-displacing contact comprising a vertically oriented principal portion having an insulation-displacing connection slot, and an extended portion connected to a lower end of the principal portion, the method comprising the steps of:

beveling edges of the extended portions of both contacts of a conjugate pair along the same side of the pair to taper a width of each of the contacts in a direction away from its principal portion, and beveling edges of the extended portions of another conjugate pair of contacts located immediately adjacent the aforesaid pair, and shaped in the mirror image of the aforesaid pair with the beveled edges of the adjacent pairs facing each other, bending each extended portion toward the opposing extended portion of the opposite contact of its conjugate pair; and connecting both extended portions of the contacts of each pair to form a linking bridge.

5. A method of building a terminal block with reduced crosstalk for terminal blocks having at least two parallel rows of opposing metal insulation-displacing contacts grouped in conjugate pairs, each contact being capable of receiving one wire of a two-wire line, and each insulation-displacing contact comprising a vertically oriented principal portion having an insulation-displacing slot, and an extended portion connected to a lower end of the principal portion, the method comprising the steps of:

providing each contact with an elastically displaceable portion having a contact stud at a free end thereof for connection with a contact stud on the elastically extendable portion of an opposing contact thereby forming a linking bridge between the contact studs of that pair, beveling edges of the extended portions of both contacts of a conjugate pair along the same side of the pair to taper a width of each of the contacts in a direction away from its principal portion, and shaping another conjugate pair of contacts located immediately adjacent the aforesaid pair, in a mirror image of the aforesaid pair with the beveled edges of the adjacent pairs facing each other.

* * * * *